United States Patent [19]

Cassell et al.

[11] 3,994,030

[45] Nov. 30, 1976

[54] BATH SEAT LIFT

[76] Inventors: James Cassell; Clyde R. Cassell, Jr., both of Rte. No. 1, Chadds Ford, Pa. 19317

[22] Filed: Jan. 27, 1975

[21] Appl. No.: 538,266

[52] U.S. Cl. ..... 4/185 L

[51] Int. Cl.[2] ..... A47K 3/12

[58] Field of Search ..... 4/185 R, 185 L; 92/108, 92/109; 187/8.75, 8.41; 254/93 H; 5/83

[56] References Cited

UNITED STATES PATENTS

| | | | |
|---|---|---|---|
| 3,078,473 | 2/1963 | Daniels | 4/185 L |
| 3,188,657 | 6/1965 | Cotner | 4/185 L |
| 3,280,409 | 10/1966 | Cotner | 4/185 L |
| 3,286,970 | 11/1966 | Nolan | 4/185 L X |
| 3,371,357 | 3/1968 | Barthelsen et al. | 4/185 L X |
| 3,381,317 | 5/1968 | Daniels et al. | 4/185 L |
| 3,815,163 | 6/1974 | Sullivan | 4/185 L |
| 3,879,770 | 4/1975 | Grant | 4/185 L |

*Primary Examiner*—Henry K. Artis
*Attorney, Agent, or Firm*—Stuart S. Bowie

[57] ABSTRACT

This invention is concerned with apparatus for moving an invalided person into and out of a bathing tub via a seat capable of being moved vertically with respect to the tub and can be pivoted from a position inside of the tub to a position outside of the tub. The mechanism is operated hydraulically, using as a source of energy — any pressurized water supply.

2 Claims, 15 Drawing Figures

BATH SEAT LIFT

The main function of this invention is to assist the handicapped person in their effort to get into and out of the bath area without the aid of other assistance.

Its design and function is deliberately such as to assure not only a secure method of transport but to lend itself as an attractive, easy to clean addition to any bathroom. The simple functional lines of this device, which is void of external complicated gadgetry is relatively easy to install and maintain. Its source of energy is any pressurized water supply. Feed and drain lines are contained within the Pylon structure. Exhaust fluids are ejected into the standard drainage system outside of the bath area.

Desirable features as indicated by the accompanying drawings is its ability to be raised and lowered both inside as well as outside the tub area. 180° pivot points at both ends of the Radius Plate or Arm allows for a high degree of positioning for both access and egress. This is a very favorable feature when used by persons who's mobility is greatly restricted.

The Activating Controls are located in the Seat Arm Rest Area and allows convenient manipulation of the seated occupant regardless of raised or lowered position either in or out of the bath area.

The optional semi-automatic Radial attachment moves the seat and occupant in and outside of the Tub area and requires no additional attendant.

Figure 1:
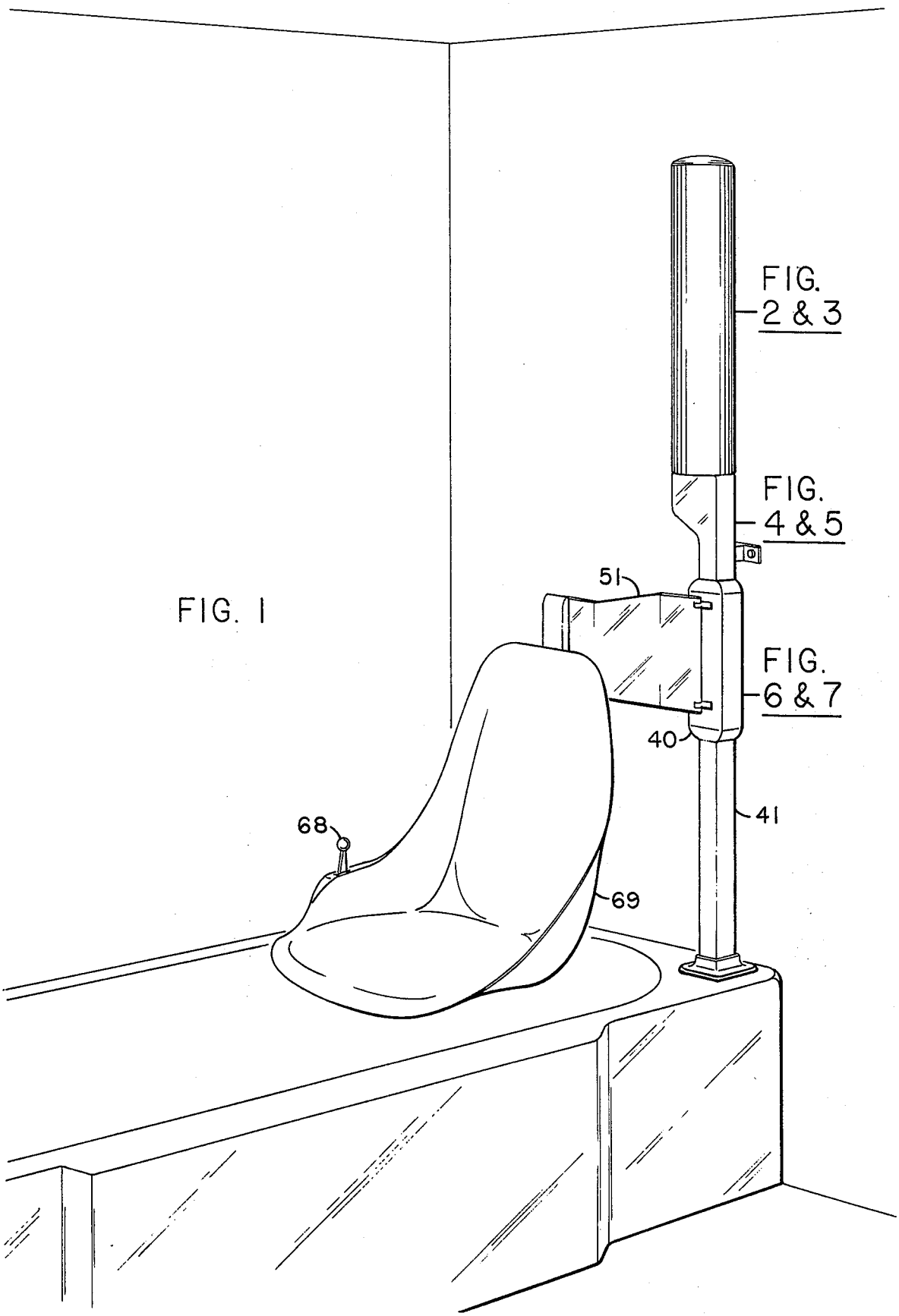

DESCRIPTIVE DRAWINGS AS FOLLOWS:

FIG. 1. This illustration is a general overall view of Bath Lift. The optional equipment, Radial Activator Assemblies, FIGS. 8, 9, 10, 11, 12, 13 and 14 are not shown in this drawing but are covered in detail in following drawings and literature. It will be noted from this illustration that due to the symetrical design of the Lift it can be installed at either end of the Bath Tub. Wall or Ceiling Brackets plus Base Plate secure it in position.

Figure 2:
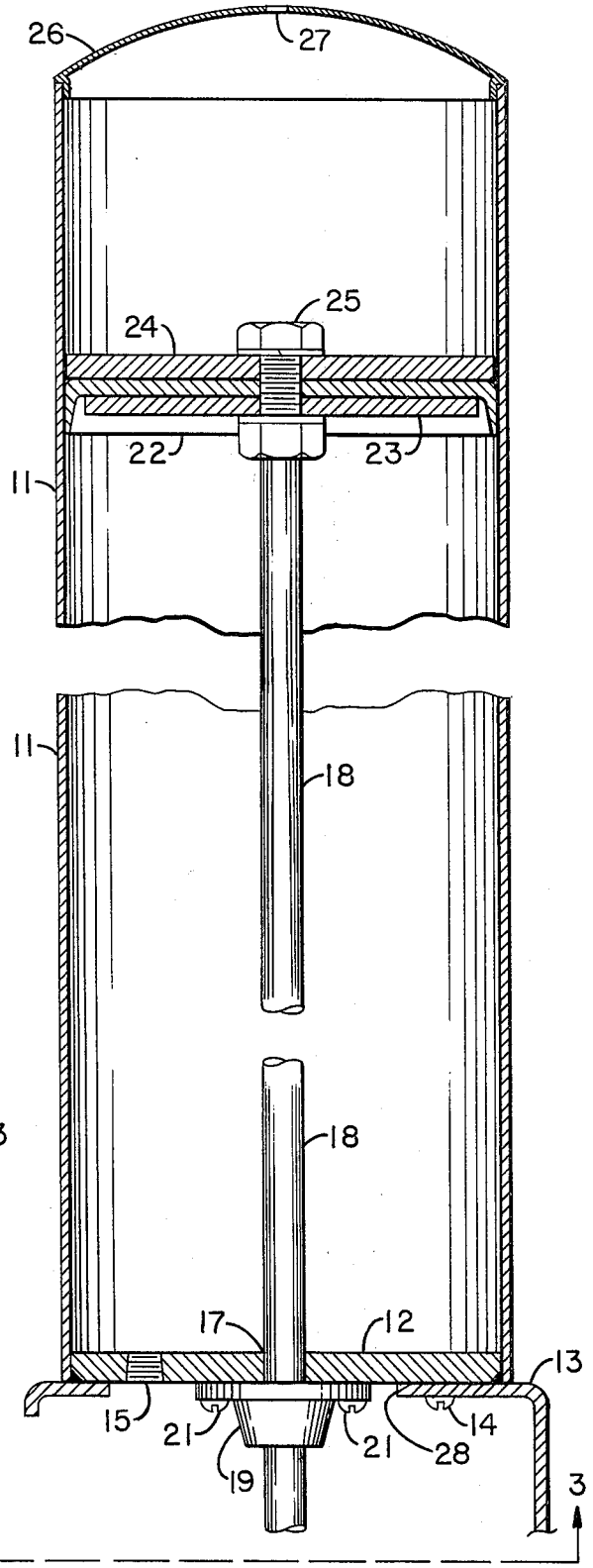

FIG. 2. This illustration is a partial sectional view of the Hydraulic Cylinder Assembly and related items.

Figure 3:
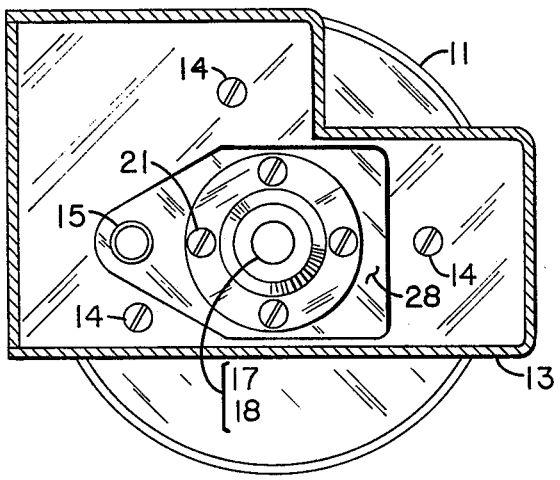

FIG. 3. This illustration is a view of FIG. 2 taken on line 3—3.

Figure 4:
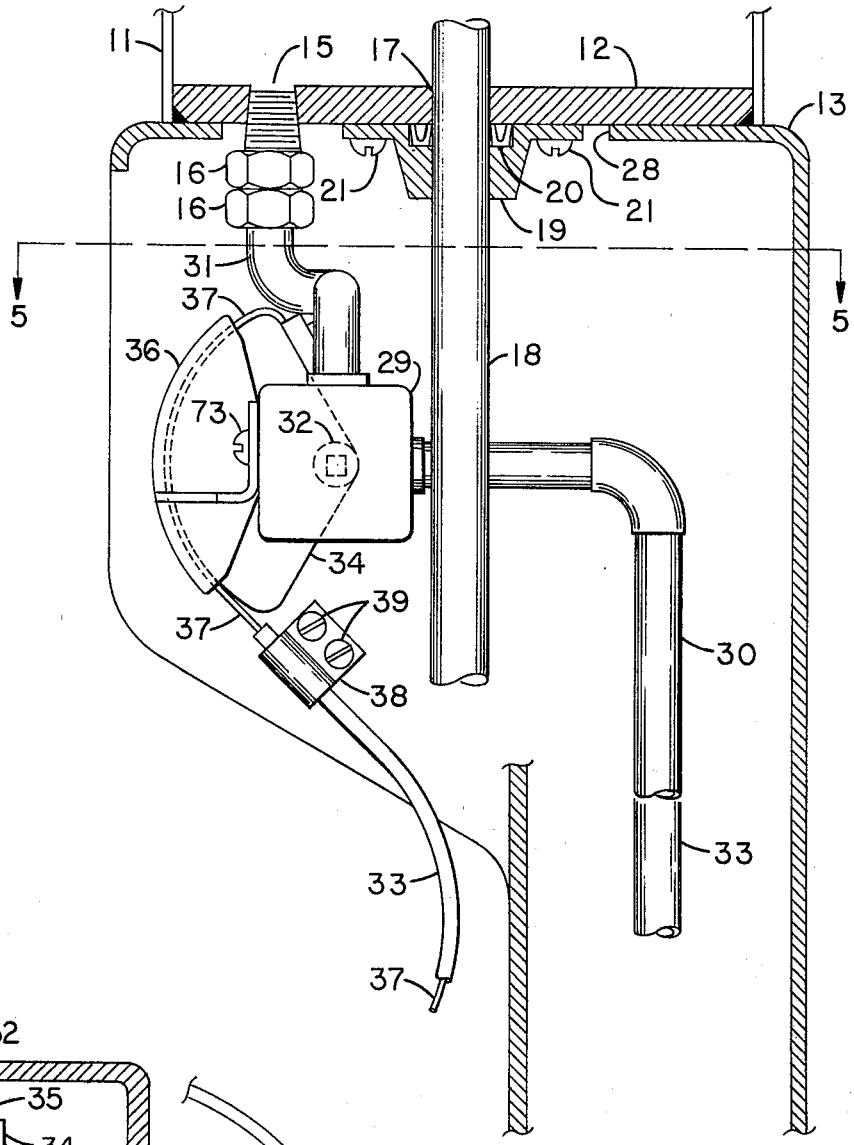

FIG. 4. This illustration is a partial sectional view of the "Pylon Head" section 13 of the Pylon 41 and illustrates the contained assemblies and related items.

Figure 5:
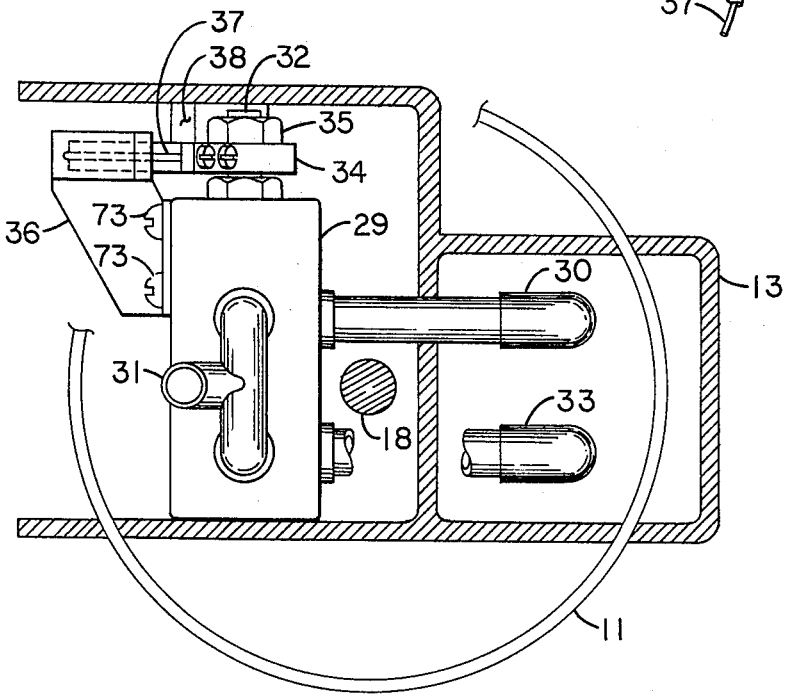

FIG. 5. This illustration is a view of FIG. 4 taken on line 5—5. Note: The partial Cylinder outline 11 is shown for positioning reference only.

Figure 6:
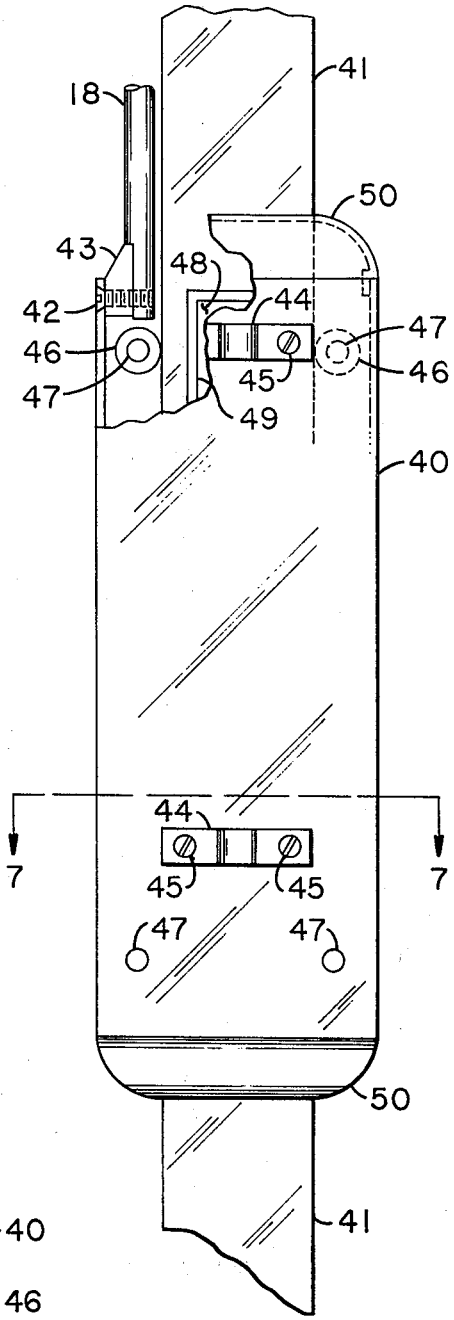

FIG. 6. This illustration is a partial cut-away view of the Glide Bar 40 and its related assemblies and parts.

Figure 7:
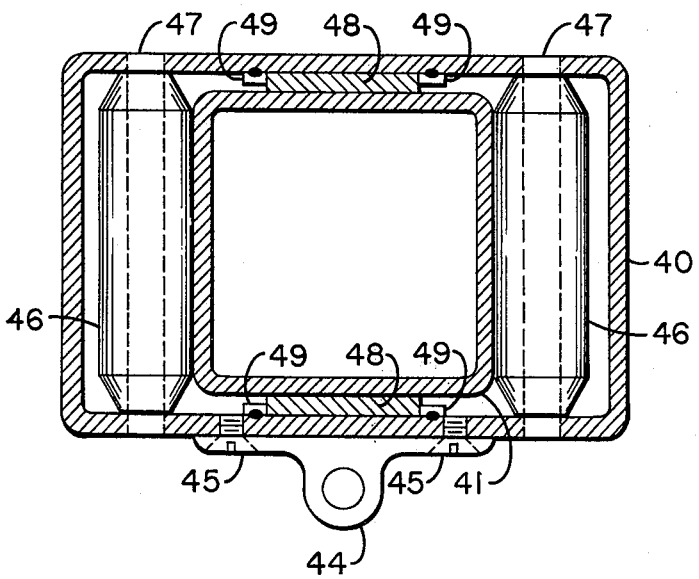

FIG. 7. This illustration is an enlarged sectional view of FIG. 6 taken on line 7—7.

Figure 8:
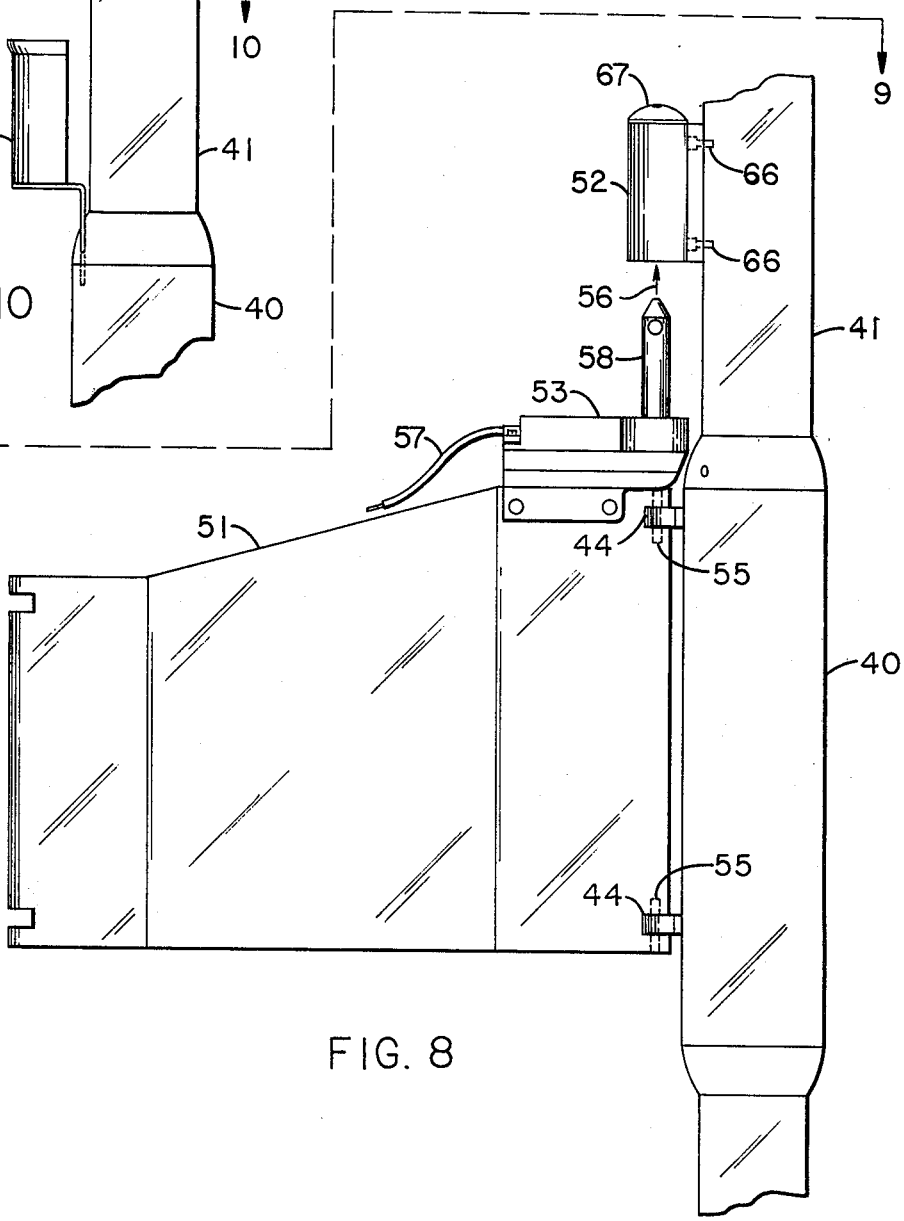

FIG. 8. This illustration depicts the general configuration and location of the Radial Activating assemblies 52, 53 and 54 with relationship to the Pylon 41, Glide Bar 40 and the Radius Plate 51.

Figure 9:
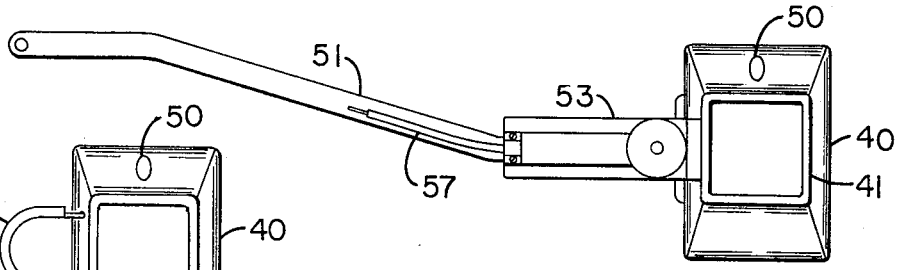

FIG. 9. This illustration is a view of FIG. 8 taken on line 9—9.

Figure 10:
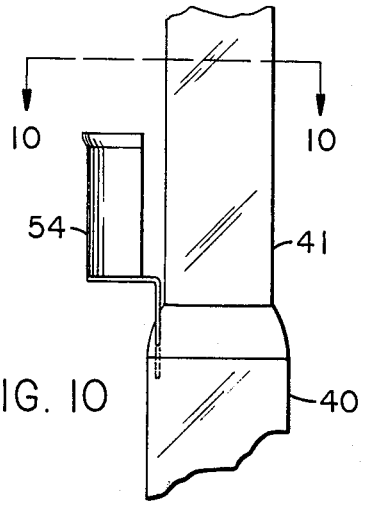

FIG. 10. This illustration shows the Floating Shield 54 and its snap-in position on the Glide Bar 40.

Figure 11:
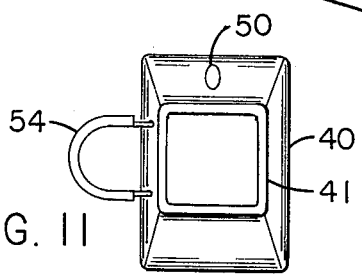

FIG. 11. This illustration is a view of FIG. 10 taken on line 10—10.

Figures 12, 13, 14:
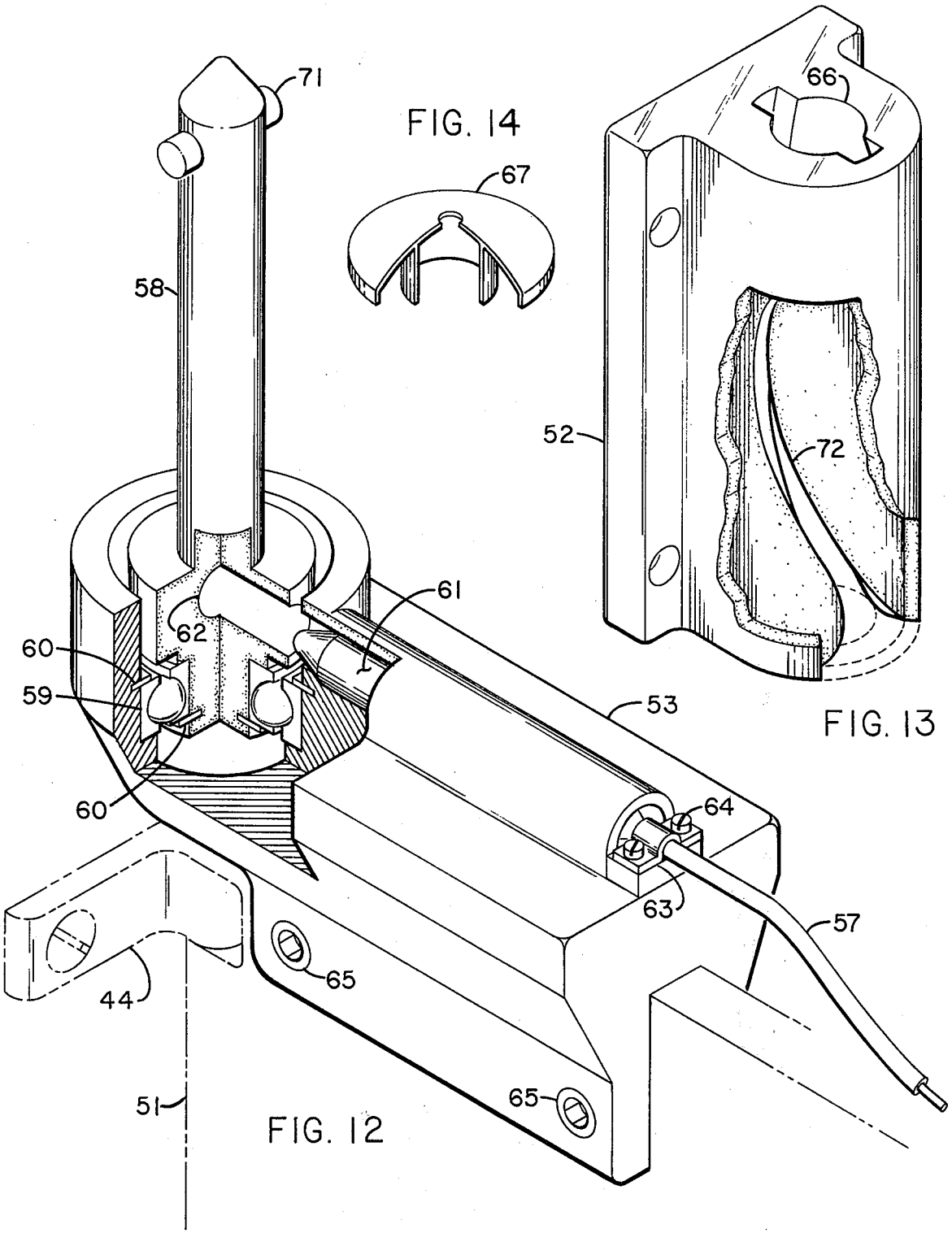

FIG. 12. This illustration is a cut-away view of the Radial Activator 53 as mounted on the Radius Plate 51 (shown in phantom line).

FIG. 13. This illustration shows a cut-away view of the general configuration of the Spiral Receptor 52.

FIG. 14. This illustration depicts a quarter cut-away view of the Snap-in Cap 67 for the top of the Spiral Receptor 52.

Figure 15:
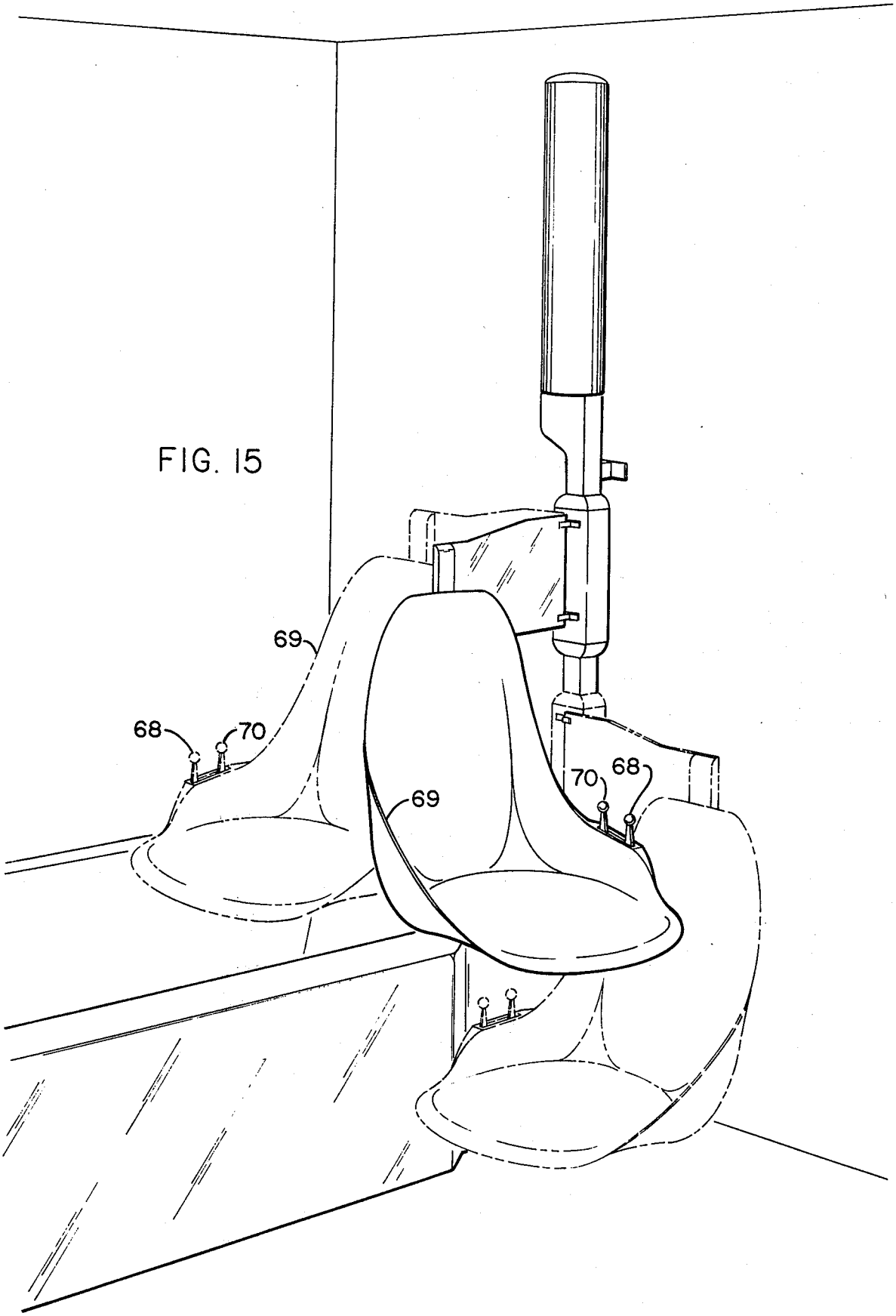

FIG. 15. This drawing illustrates some of the various positions and path of travel taken by the Seat 69.

Referring now to the Hydraulic Cylinder Assembly and related details FIGS. 2 & 3 - 4 & 5. The main function of this unit is to supply energy for lifting and activating the Seat in its various positions. Details of its construction and function are as follows: Cylinder 11 is attached at the bottom end with a Base Plate 12 by suitable means such as braising or welding. Base Plate 12 supplys the supporting feature and is attached to the Pylon Head 13 by means of Attach Screws 14. A tapered Threaded Hole 15 allows for the attachment of the Input and Output Water Supply Fittings 16 which are shown on FIG. 4. A Center Hole 17 allows for the reciprocal sliding motion of Lift Rod 18. A Seal Housing 18 and Seal 20 shown on FIG. 4, encompassing the Rod 18 is attached to the bottom of 12 with Attach Screws 21. The Lift Rod 18 which exerts a pulling force is attached at the upper end of Rod with the standard Hydraulic Cup arrangement. This consists of Cup 22, Lower Plate 23, Upper Back-up Plate 24 and suitable securing Nuts 25 on the threaded end of Rod 18. A convex snap-in Cap 26 containing a Vent Hole 27 covers the top of Cylinder 11. A suitable Hole 28 in the Pylon Head 13 allows for the proper seating of the Cylinder 11.

Further reference to FIG. 4 and FIG. 5 show the Pylon Head 13 and related assemblies therein, and their function. The first assembly of consideration is the Valve Assembly. The main body 29 consist of a standard Mixing Valve or sometimes called a Diverter Valve. Its function is to allow pressurized water to flow into the Diverting Chamber 29 from Tubing 30 and thus thru Tubing 31 into the Cylinder 11. This exerts an upward thrust on the Cup Assembly 22 and gives the Rod 18 a pulling force for raising the Glide Bar 51 of FIG. 8 and all attaching assemblies. By rotating the Valve Shaft 32 the Cylinder 11 discharges the water thru Tubing 31 and is diverted into Tubing 33 which carries it downwardly inside the square Pylon tubing where it is ejected into the standard drainage system outside the Bath Area, thus lowering the Seat. By partially rotating the Shaft 32 between the input and the discharge Ports both feed and drain are shut off and allows the Glide Bar and all attaching assemblies to come to rest at any desired vertical position.

Control of Valve 29 is accomplished with a Push-Pull Cable 33 which is attached to a circular Guide Plate 34. The Guide Plate 34 is locked on to Valve Shaft 32 with Nut 35 at its Radial Center. A containing Cable Shield 36 partially covers the Guide Plate and controls allignment and path of travel of the Cable Wire 37.

The Cable Shield 36 is attached to the Valve Body 29 with Attach Screws 73. The flexible Cable 33 is rigidly held in position by Clamp 38 which is attached to the wall of Pylon Head 13 by Attach Screws 39. The Flexible Cable 33 travels from the Pylon Head area 13 downward to attach points on the Radius Plate 51 and hence to the Control Lever 68 on the Bath Seat Arm Rest. Enough slack in the Cable 33 is furnished between the Radius Plate 51 and Pylon Head 13 to accommodate vertical travel to the system.

Attention is now drawn to the Glide Bar 40 and related assemblies in FIG. 6 and FIG. 7. The main function of this unit is to supply a suitable means of supporting the Bath Lift Seat 69, the Radius Plate 51 and related assemblies. The Glide Bar 40 encompasses the Pylon 41 and achieves vertical movement by being attached to the end of Lift Rod 18 with Attach Screw 42 and Spacer 43. Two Brackets 44 supply support for the Radius Plate 51 and are attached as shown with Screws 45.

The major loading factor is carried by four Rollers 46 that ride the Pylon Wall 41 and are secured in the Glide Bar 40 with Pins 47. Teflon Pads 48 secured in place with spot welded Metal Strips 49 act as spacers between the walls of the Glide Bar 40 and Pylon 41. Contoured Caps 50 cover each end of the Glide Bar 40 as seen in FIG. 6 and FIG. 9 and act as anti-containment shields. The Upper Cap as seen in FIG. 9 has a Hole 50 which allows the Lift Rod 18 to enter and be connected to the upper Lip of the Glide Bar 40.

Referring now to FIGS. 8, 9, 10 and 11. These Figures deal primarily with the general configuration and assembled views of the Pylon 41, Glide Bar 40, Radius Plate 51, Spiral Receptor 52, Radial Activator 53 and Floating Shield 54. The Radius Plate 51 is attached to Brackets 44 with Pins 55 and is capable of 180° movement. FIG. 8 shows the Radial Activator 53 in its upward travel indicated by Arrow 56 a moment before entering the Spiral Bracket 52. The Floating Shield 54 allows a measure of protection from the moving parts of 53. A Flexible Cable 57 for activating 53 traverses the Radius Plate 51 and back of Seat 69 and is connected to a Control Lever 70 on the Seat and Arm Rest. See FIG. 15.

Attention is now drawn to FIGS. 12, 13 and 14. FIG. 12 is a cut-away detail view of the Activator Assembly 53. The Pin 58 is mounted in the Activator Housing 53 on a ball thrust Bearing 59. The Bearing 59 and Pin 58 are secured in place by two Snap or Retainer Rings 60.

The Pin 58 can rotate freely unless the Lock Bar 61 is inserted into a Hole 62. The Lock Bar 61 is inserted or removed from the Hole 62 by means of the push-pull Cable 57 which is controlled by the Seat Arm Rest Lever 70 in FIG. 15.

The resultant action of the Lock Bar being engaged or disengaged is the horizontal movement of the Radius Plate 51 and Seat 69 in or outside of the Tub Area. This action will be covered more fully in a later paragraph. The Flexible Cable 57 is secured to the Activator Housing 53 with a Bracket 63 and Attach Screws 64. The Activator Housing 53 is attached to the Radius Plate 58 in a manor that Pin 58 is located in direct allignment with the pivot points of Radius Plate 51 and Bracket 44. Attach Screws 65 secure 53 to 51.

Cut-away view in FIG. 13 is the Spiral Receptor. A slotted Hole 66 runs the full length of this unit and spirals from top to bottom 180°. It is attached to the Pylon 41 as shown in FIG. 8 by Attach Screws 66.

Cut-away view of a protective Snap-in Cap 67 presses into Hole 66.

To utilize the Radial Activator Assembly in FIGS. 12, 13 and 14 the following operational procedure is used.

1. To move the seat up and outside the Bath Area, engage the Lock Bar 61 by pushing the Control Lever 70 forward.

2. To lower Seat outside the Tub Area disengage the Lock Bar 61 by pulling the Control Lever 70 backwards.

3. To move the Seat from outside the Tub Area, leave Lock Bar 61 engaged until over the Bath Area. Disengage Lock Bar 61 by pulling Control Lever 70 to lower into Tub.

4. By leaving the Lock Bar 61 disengaged no lateral movement is achieved and Seat may be moved manually. When the Lock Bar 61 is engaged radial movement of the set in either direction is accomplished when the Pin 58 and the Cam Follower Studs 71 travel the Spiral Slot 72 in the Spiral Bracket 52.

What we claim is:

1. A bath lift apparatus for moving a person into and out of a bathing tub comprising a. a vertical pylon mounted adjacent the tub;

b. a glide bar slidably connected to the pylon for vertical movement;

c. a radius plate support member connected to the glide bar and movable in substantially a horizontal plane with respect thereto;

d. guide pin means mounted on the radius plate, said pin means including a follower means and being adapted to rotate with respect to the radius plate;

e. a receptor bracket on the pylon, said bracket having a receptacle for receiving the guide pin and said receptacle having an upwardly extending groove for receiving the follower means of the pin;

f. locking means for securing guide pin from rotational movement;

g. a seat connected to the radius plate;

h. a hydraulic piston connected to the glide bar by linkage means operable to move the glide bar vertically whereby the radius plate and chair are moved up and down;

i. control means for the hydraulic piston; and j. control means for the locking means.

2. The invention of claim 1 wherein the locking means comprises a slidable member mounted on the radius plate adjacent the guide pin; wherein the guide pin includes means for receiving the slidable member whereby the guide pin is secured against rotational movement; and wherein said control means for the locking means includes a cable for moving the slidable member into engagement with the guide pin to secure the same from rotational movement and out from said engagement, whereby said guide pin is free to move in rotational direction.

* * * * *